United States Patent [19]

Eriksson et al.

[11] Patent Number: 4,811,309

[45] Date of Patent: Mar. 7, 1989

[54] MICROPHONE PROBE FOR ACOUSTIC MEASUREMENT IN TURBULENT FLOW

[75] Inventors: Larry J. Eriksson, Madison; Mark C. Allie, Oregon; Richard H. Hoops, Stoughton, all of Wis.

[73] Assignee: Nelson Industries Inc., Stoughton, Wis.

[21] Appl. No.: 94,753

[22] Filed: Sep. 4, 1987

[51] Int. Cl.[4] ..... H04R 23/00

[52] U.S. Cl. ..... 367/140; 367/174; 381/71; 381/154

[58] Field of Search ..... 367/140, 174, 901, 153; 73/591, 592, 861.23, 861.18, 861.28, 405 A, 646; 381/154, 71, 56; 181/184

[56] References Cited

U.S. PATENT DOCUMENTS

| | | | |
|---|---|---|---|
| 3,444,955 | 5/1969 | Hoffman | 381/154 |
| 4,421,957 | 12/1983 | Wallace | 181/184 |
| 4,703,506 | 10/1987 | Sakamoto et al. . | |

OTHER PUBLICATIONS

"Noise & Vibration Control", Beranek, McGraw-Hill Book Company, 1971.

Journal of Sound and Vibration "The Flow Noise Level at Microphones in Flow Ducts" Neiss et al., 1979, 63(4), 561-579.

J. Acoust, Soc. Am, "Tubular Windscreen Design for Microphones for In-Duct Fan Sound Power Measurements", Wang et al., vol. 55, No. 3, Mar. 1974.

"Measuring Microphones, Studio Microphones, Hydrophones and Accessory Equipment" Group 3 UA0436.

The American Society of Mechanical Engineers, "Active Attenuation in Flow Ducts: Assessmen of Prospective Applications" Shephard et al., Dec. 1986.

Journal of Sound and Vibration "Theoretical and Experimental Investigations of Microphone Probes for Sound Measurements in Turbulent Flow" 1975, vol. 39(3), 371-400.

Journal of Sound and Vibration, "Microphone Screens for Acoustic Measurement in Turbeltn Flows", Shepherd, 1986, Co. 111(1), 153-165.

*Primary Examiner*—Deborah L. Kyle
*Assistant Examiner*—John W. Eldred
*Attorney, Agent, or Firm*—Andrus, Sceales, Starke & Sawall

[57] ABSTRACT

A microphone probe for acoustic measurement in turbulent flow. The probe includes a tube having a closed end facing upstream with respect to the direction of sound propagation, and a microphone is located in the downstream end of the tube. The tube is provided with a plurality of small ports, or alternately a slit, that extend a substantial portion of the length of the tube and an acoustically resistive material is stretched across the ports and clamped to the tube. In one form of the invention, the side edges of the material are connected to rigid bars and the bars are drawn together by a plurality of threaded fasteners to stretch the material over the ports. The threaded adjustment of the fasteners provides a means for varying the acoustical resistance of the material. In a second form of the invention, the bars to which the side edges of the material are attached, are clamped together by spring clips.

24 Claims, 4 Drawing Sheets

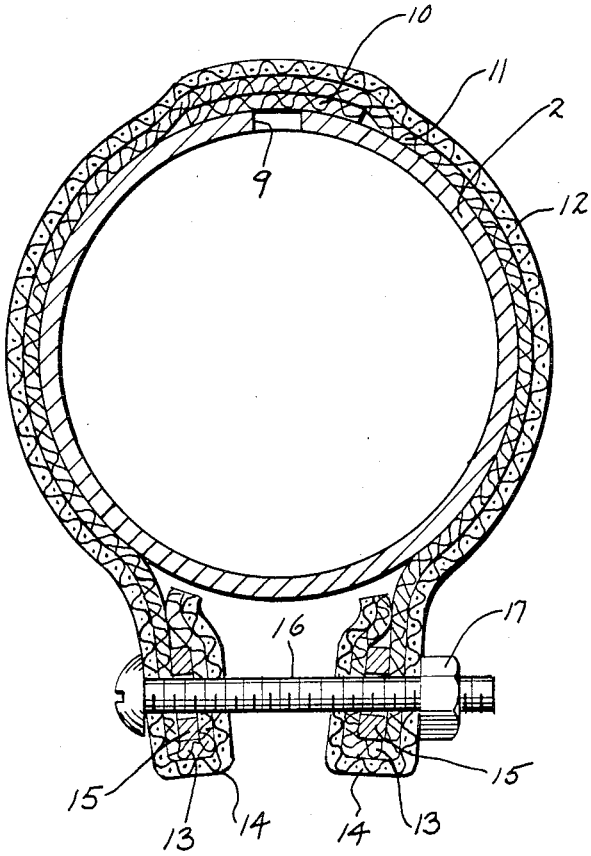
FIG. 3
FIG. 5
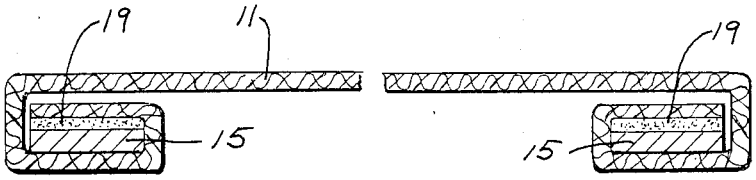
FIG. 4
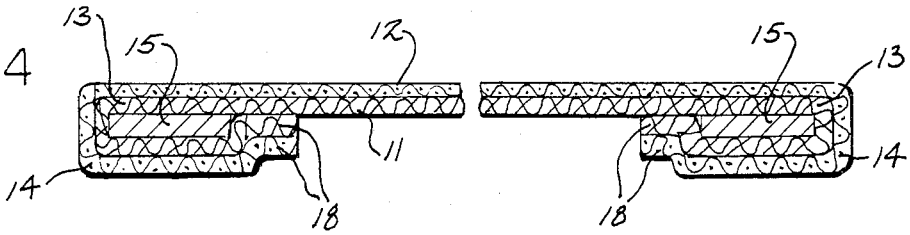

MICROPHONE PROBE FOR ACOUSTIC MEASUREMENT IN TURBULENT FLOW

BACKGROUND OF THE INVENTION

Sound energy emitted by sound sources, such as centrifugal or axial flow fans, is often measured through use of a microphone but the measurement is often complicated because of the presence of flow noise.

Flow noise can be generated by two sources. First, there is self-noise caused by the presence of the microphone unit itself. Microphone nose cones and wind screens can act to reduce this self-noise. Second, there is flow noise associated with the turbulent pressure fluctuations caused by the fan. Probe tubes have been proposed in an attempt to desensitize the microphones to turbulent flow pressure fluctuations. In general, the microphone probes, as used in the past, have consisted of an elongated tube having a tapered end facing upstream of the direction of sound propagation and containing a microphone in the opposite end. The tube includes a plurality of small spaced openings, or alternately, an elongated slit, which is covered with an acoustically resistive material, such as cloth or felt. Screens of this type are designed to distinguish between turbulent pressure fluctuations, which have a low propagation velocity, and sound pressure fluctuations, which have a much higher propagation velocity. Pressure fluctuations at locations on the tube cause pressure waves to propagate inside of the tube with the propagation velocity being nearly equal to the speed of sound. If the pressure fluctuations are sound waves, the pressure waves from all locations will add constructively and create a high sound pressure at the microphone because the propagation velocity of the sound inside and outside of the tube is nearly the same.

On the other hand, if the pressure fluctuations are caused by turbulent flow around the tube, the pressure waves inside the tube will add destructively, because the propagation velocity inside the tube is much higher than the propagation velocity of the turbulence outside the tube, and thus only a small pressure will therefore be created at the microphone diaphragm.

However, problems have arisen with the use of conventional microphone probes. The ability of the probe to screen turbulent flow pressure fluctuations is affected by the tautness of the acoustic material which is disposed across the openings or slit in the tube. In the past, the material has been applied to the tube as a helical or spiral winding and in practice certain portions of the material may be more tightly wound than others, thereby providing a non-uniform acoustic resistance and adversely affecting performance of the instrument. Alternatively, the material has simply been held against the openings with no control over the acoustic resistance.

SUMMARY OF THE INVENTION

The invention is directed to an improved microphone probe for measuring acoustical energy in turbulent flow. The probe comprises an elongated tube having a closed end facing upstream in the direction of sound propagation and having a microphone located in the downstream end of the tube.

Located along the length of the tube are a plurality of holes or ports, or alternately, the tube can be formed with an elongated slit.

In accordance with the invention, an acoustically resistive material is stretched across the holes and clamped to the tube. In a preferred form of the invention, the side edges of the material are connected to a pair of rigid bars and the bars are drawn together at a location opposite the holes by adjustable fasteners, such as bolts, to stretch the material over the holes and thereby provide uniform acoustical resistance for the portions of the material enclosing the holes. Through threaded adjustment of the bolts, the acoustical resistance of the material can be varied as desired.

The acoustical resistive material can be either woven or unwoven fibrous material, such as fiber glass or felt, and can also include a protective outer metal screen.

In another form of the invention, the side edges of the acoustically resistive material are connected to a pair of elongated rods and the rods are clamped together by spring clips to stretch the material across the holes.

In a further form of the invention, the side edges of the material can be connected to the rods through resilient C-shaped clamps, and spring clips are then employed to clamp the C-clamps together to stretch the material across the holes.

The invention enables the acoustically resistive material to be uniformly stretched across the series of holes to provide uniform acoustical resistance throughout the length of the tube, and the material can be readily adjusted in tautness to vary the flow resistance, as desired.

The clamping mechanism, as used in the invention, enables multiple layers of acoustical media to be utilized, and the mechanism can be readily assembled and disassembled with the tube for service or replacement of the acoustical media.

In accordance with another aspect of the invention, a plurality of microphone probes can be disposed in parallel relation in the duct with the closed ends of the probes facing the source of sound energy. The signal generated by the microphone of each probe is transmitted to a summing amplifier which produces a summed output signal. Alternately, a plurality of probes that are disposed in parallel relation in the sound duct are joined to a single microphone which generates an output signal. The turbulent pressure fluctuations are randomly distributed in the sound duct and the use of a plurality of probes provides more precise spatial averaging of the random pressure fluctuations.

Other objects and advantages will appear in the course of the following description.

DESCRIPTION OF THE DRAWINGS

The drawings illustrate the best mode presently contemplated of carrying out the invention.

In the drawings:

FIG. 3 is a section taken along line 3—3 of FIG. 2;

FIG. 4 is an enlarged transfer section showing the acoustic media attached to clamping strips;

FIG. 5 is a view similar to FIG. 4 showing a modified form of the invention in which the acoustic media is attached to the clamping strips through use of an adhesive;

DESCRIPTION OF THE ILLUSTRATED EMBODIMENT

Figure 1:
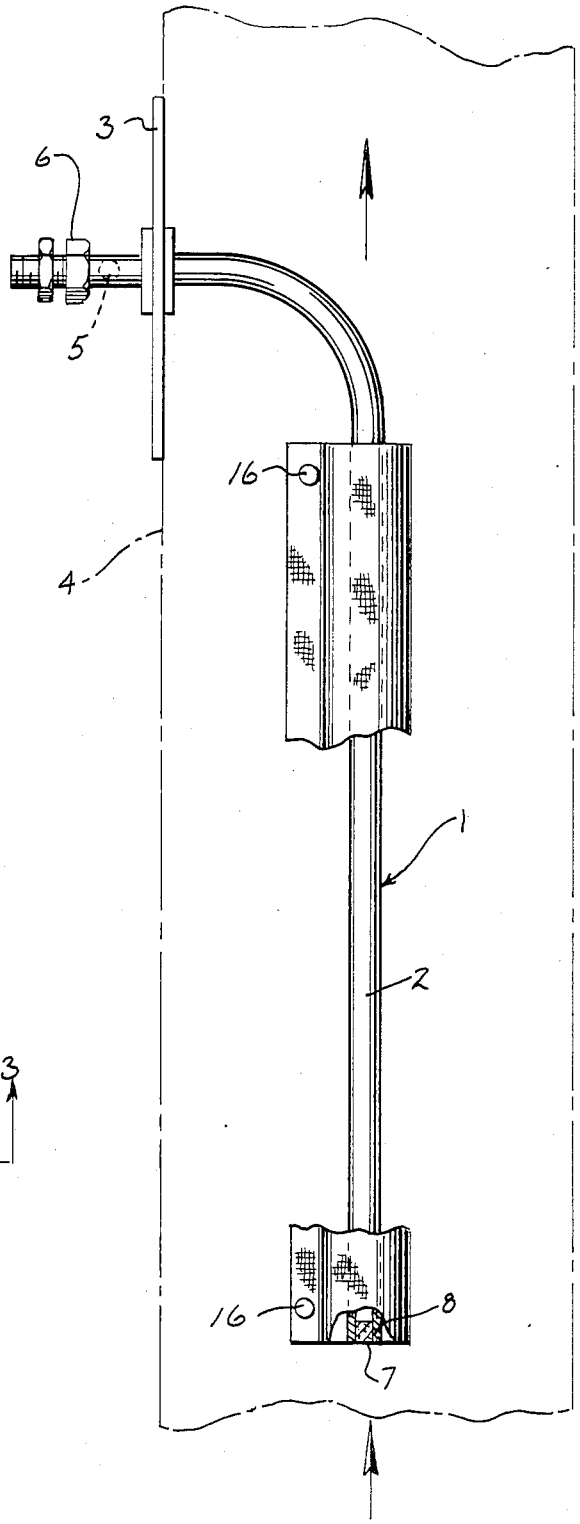
FIG. 1 is a side elevation of the microphone measuring probe of the invention.

FIG. 1 illustrates a microphone probe to be used for acoustical measurement in turbulent flow. Probe 1 includes an elongated metal tube 2 having a bent outer end carrying a mounting plate 3 that is adapted to be mounted on a duct 4 or other conduit through which sound is propagating. While the drawings illustrate the probe 1 used in association with a duct, it is contemplated that the probe can be utilized in any fluid flow path to measure the sound energy.

A conventional microphone 5 is located within the outer bent end of tube 2 and the end of the tube can be connected through coupling 6 to a conduit which contains the electrical leads connected to microphone 5.

The inner end of tube 2 faces upstream in the direction of sound propagation in duct 4 and is closed off by a plug 7 of acoustical media, such as felt, that is located within a sleeve 8 attached to the end of tube 2.

Spaced along the length of tube 2 are a plurality of holes or openings 9, which extend substantially the full length of the straight inner section of tube 2. While the drawings illustrate the use of openings 9, it is contemplated that as an alternate construction, tube 2 can contain an elongated continuous slit.

As best illustrated in FIG. 3, a strip 10 of acoustically resistive material, such as fiber glass, is positioned on the outer surface of tube 1 and covers the openings 9. A second layer 11 of acoustically resistive material, such as felt, is positioned on the outside of layer 10 and extends substantially around the entire circumference of tube 2. In addition, an outer protective metal screen 12 can be positioned around the layer 11 and is generally co-extensive in circumferential width with layer 10. Both the layer 11 and screen 12 are provided with reversely bent ends, 13 and 14 respectively, which are secured around metal strips 15. Layers 10 and 11, as well as screen 12 and strips 15, all have a comparable axial length.

As shown in FIG. 3, strips 15 are located generally diametrically opposite the openings 9, and the strips are drawn together to clamp and stretch the layers 10 and 11 across the openings 9. The clamping is accomplished through use of a plurality of bolts 16, which are spaced along the length of tube 2 and extend through aligned openings in strips 15 as well as through layer 11 and screen 12. The threaded ends of bolts 16 receive nuts 17. By threading down the nuts 17, the acoustical media will be stretched across openings 9.

It is recognized that the flow resistivity of the acoustic media is dependent on its density and the fiber diameter. Thus, by stretching the acoustic media across the holes 9, the flow resistivity of the acoustical layers 10 and 11, can be varied as desired. The felt layer 11 has sufficient strength and integrity so that it can be stretched without tearing or rupturing.

In operation, sound pressure fluctuations at locations on the tube cause pressure waves to propagate through the holes to the inside of the tube with the propagation velocity being nearly equal to the speed of sound. The pressure waves add constructively to create a high sound pressure at the microphone 5. Turbulent flow pressure fluctuations, on the other hand, create pressure waves inside the tube that add destructively, so that only a small pressure will be created at the microphone. Thus, the turbulent flow pressure fluctuations will be essentially screened out. The acoustic plug 7 acts to dampen the standing wave pattern in the tube.

FIG. 4 illustrates the pre-assembly of the acoustical layers to strips 15 prior to assembly with tube 2. As shown in FIG. 4, the ends 18 of layer 11 and screen 12 can be connected to the main body of these layers by stitching, or mechanical fasteners, so that the side edges of the media layers are firmly connected around strips 15.

FIG. 5 is a view similar to FIG. 4 showing an alternate method of connecting the acoustical resistive layer 11 to the metal strips 15. In this construction, the side edges of the layer 11 are bent or rolled around the strips 15 and the side edges are connected to the strips by a layer of an adhesive 19.

Figure 2:
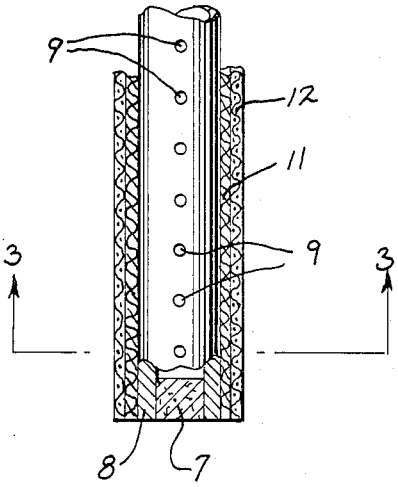
FIG. 2 is an enlarged fragmentary longitudinal section of the end of the probe.

The acoustical layer 11 as shown in FIG. 5 can be wrapped over the layer 10 on tube 2 and clamped to the tube in the manner illustrated in FIGS. 1–3.

Figure 6:
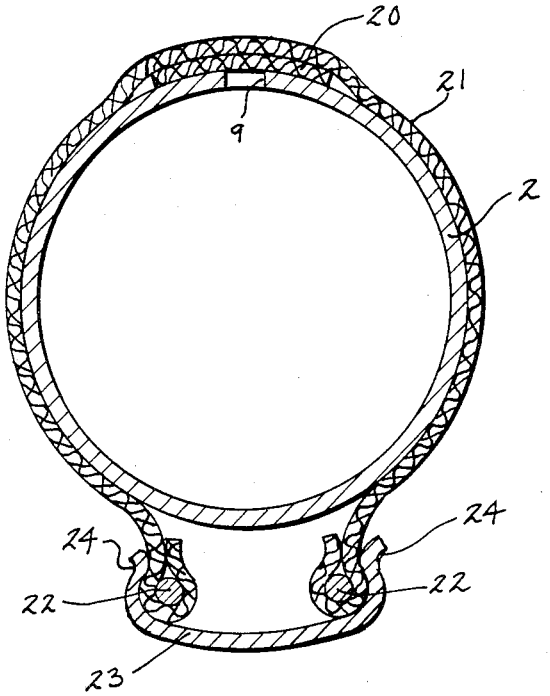
FIG. 6 is a view similar to FIG. 3 and shows a modified form of the invention in which the ends of the acoustic media are attached to the tube through use of a spring clip.

FIG. 6 illustrates a modified form of the invention in which the openings 9 in tube 2 are enclosed by a strip 20 of acoustically resistive material, such as fiber glass, similar to the strip 10 of the first embodiment. A second layer 21 of acoustically resistive material, such as felt, is wrapped over strip 20 and the side edges of layer 21 are attached around metal rods 22 by stitching or mechanical fasteners. Resilient spring clips 23 are employed to clamp rods 22 together, and as shown in FIG. 6, the side flanges 24 of the clips 23 engage the rods and the resilient nature of the clips acts to draw the rods together to stretch the acoustical media over the openings 9.

A group of spring clips 23 can be utilized which are spaced along the length of the rods 21, or alternately, single spring clip having a length approximately the same as rods 21 can be employed.

Figure 7:
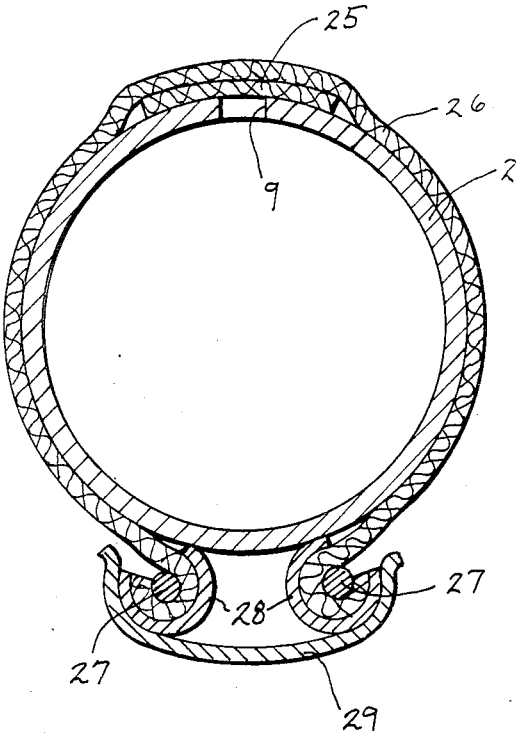
FIG. 7 is a view similar to FIG. 6 showing another form of the invention in which the ends of the acoustic media are attached to longitudinal rods through use of clamps and spring clips connect the clamps together.

FIG. 7 shows a further modified form of the invention in which a strip 25 of acoustic media, such as fiber glass, is positioned over the row of holes 9 and is covered by a layer of acoustic media 26, such as felt. The longitudinal side edges of the felt layer 26 are clamped to longitudinal rods 27 by resilient C-clamps 28 so that the edges of the felt are firmly secured to the rods.

Clips 29, similar in construction and function to clips 23, are utilized to clamp the rods 27 together to thereby stretch the acoustic media across the holes 9.

Figure 8:
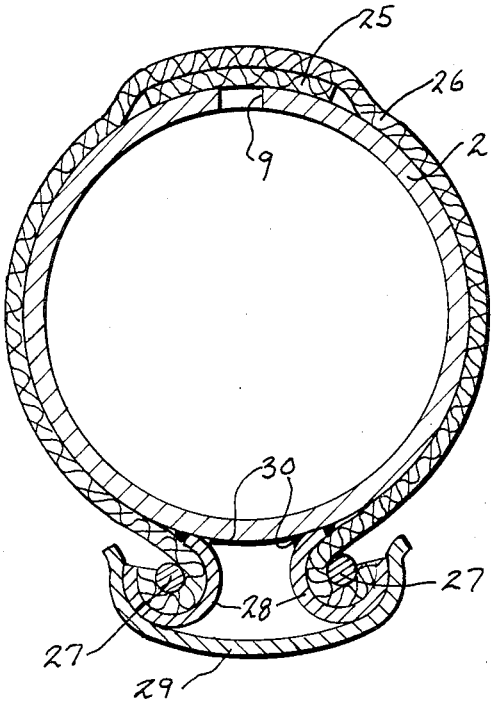
FIG. 8 is a view similar to FIG. 7 showing a further modified form of the invention in which the clamps are welded to the tube.

FIG. 8 shows a further modified form of the invention which is similar to that described in FIG. 7 except that the inner ends of the C-clamps 28 are permanently affixed as by welds 30 to the outer surface of tube 2. As previously described, the clamps 28 serve rods 27 and the spring clips 29 act to draw the rods together to stretch the acoustic media over the holes 9.

The invention provides an improved microphone probe for acoustical measurement in turbulent flow in which the acoustic media is stretched in a taut and uniform condition across the openings in the probe. The invention also includes a mechanism for adjusting the tension on the acoustic media to thereby vary the acoustical resistance of the material, as desired.

As shown in the drawings, the mechanism of the invention can be employed to attach a single or multiple layers of acoustic media to the probe.

Figure 9:
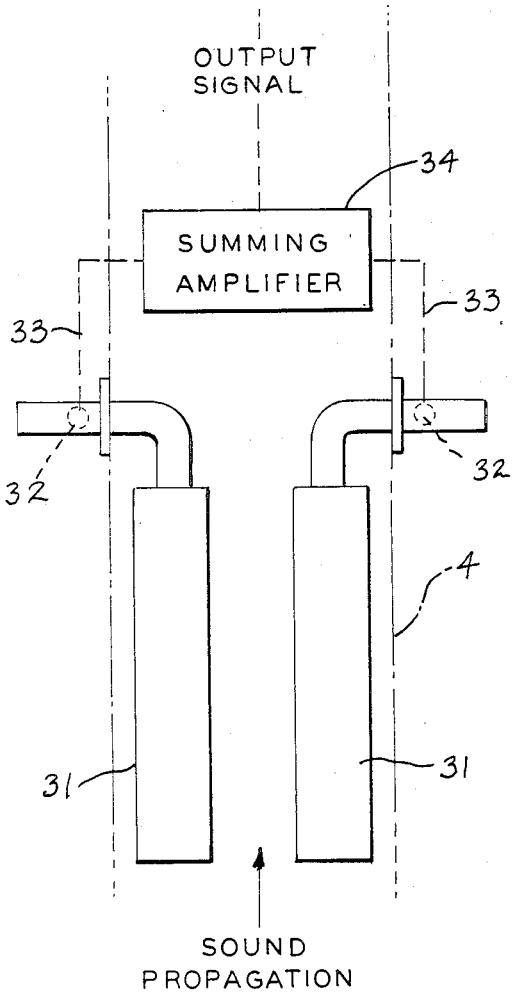
FIG. 9 is a schematic representation of a system utilizing a pair of microphone probes which are connected to a summing amplifier.

The turbulent pressure fluctuations are randomly distributed in duct 4, and to provide a more accurate spatial averaging of the fluctuations, two or more probes 31 can be utilized, as shown in FIG. 9. The probes 31, which can be of similar construction to the probes previously described, are mounted in spaced parallel relation in duct 4, preferably at diametrically opposite locations. The probes can be offset longitudinally, but the offset distance should be substantially less than the wave length of the sound energy.

As illustrated in FIG. 9, the microphone 32 of each probe 31 is connected by leads 33 to a summing amplifier 34 which generates a summed output signal.

The use of the plurality of probes provides more precise spatial averaging of the random turbulent pressure fluctuations in duct 4.

Figure 10:
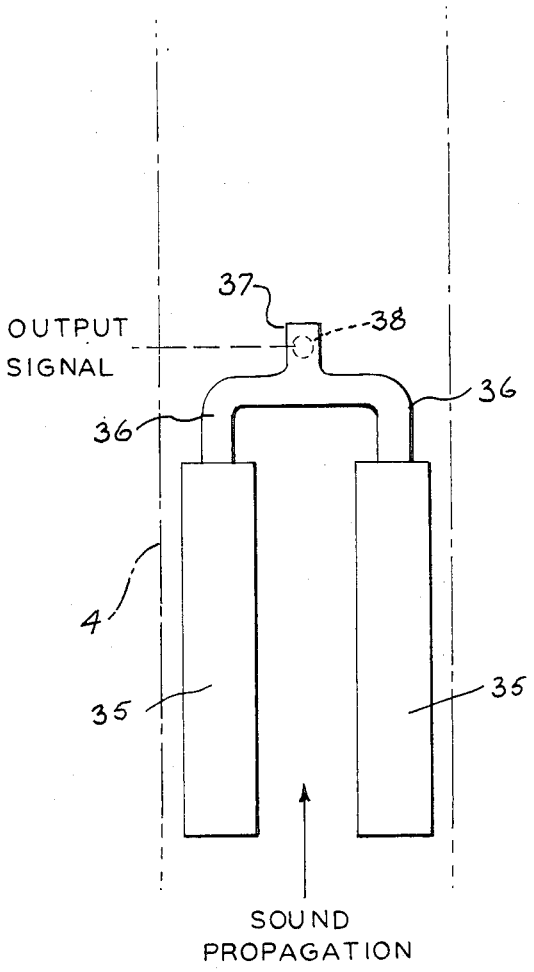
FIG. 10 is a schematic representation of a system using a pair of probes that are joined to a single microphone.

FIG. 10 illustrates a further modified form of the invention employing a plurality of probes. In this system a pair of probes 35, similar in construction to the probes previously described, are positioned in spaced parallel relation in duct 4. The corresponding ends of probes 35, facing away from the source of sound energy, are bent laterally, as indicated by 36, and joined together at an extension 37. A single microphone 38 is located in extension 36. As in the case of the construction of FIG. 9, the system of FIG. 10, using a plurality of probes 35, provides a more accurate averaging of the randomly distributed turbulent pressure fluctuations in duct 4.

Various modes of carrying out the invention are contemplated as being within the scope of the following claims particularly pointing out and distinctly claiming the subject matter which is regarded as the invention.

We claim:

1. A microphone probe for acoustical measurement in turbulent flow, comprising a tube to be disposed in a sound field and having a closed end facing a source of sound energy, a microphone disposed in said tube downstream in the direction of sound propagation from said closed end, aperture means in said tube and located downstream of said closed end, acoustically resistive material disposed over said aperture means, clamping means for clamping said material to said tube and stretching said material across said aperture means, said clamping means comprising at least one rigid member disposed longitudinally of said tube and located in circumferentially spaced relation to said aperture means, said material connected to said member, and connecting means for stretching said material cross said aperture means.

2. The probe of claim 1, wherein said aperture means comprises a plurality of spaced openings.

3. The probe of claim 1, wherein said rigid member is disposed generally diametrically opposite said aperture means.

4. The probe of claim 1, wherein said clamping means comprises a pair of rigid members disposed longitudinally of said tube and located in circumferentially spaced relation to said aperture means, said material interconnecting said members, and connecting means for drawing said members toward each other to stretch said material across said aperture means.

5. The probe of claim 4, wherein each rigid member comprises a metal bar and the longitudinal side edges of said material are connected to the respective bars.

6. The probe of claim 5, wherein said side edges are wrapped around the bars.

7. The probe of claim 1, wherein said connecting means comprises resilient clip means connecting said material to said rigid member.

8. The probe of claim 1 wherein said connecting means comprises adjustable fastening means connecting said material to said rigid member.

9. A microphone probe for acoustical measurement in turbulent flow, comprising a tube to be disposed in a sound field and having a closed end facing upstream of the direction of sound propagation, a microphone disposed in said tube downstream of said closed end, aperture means in said tube and located between said closed end and said microphone, an acoustically resistive material removably secured to the outer surface of said tube and extending across said aperture means, and adjusting means for varying the acoustical resistivity of said material.

10. The probe of claim 9, wherein said material comprises a first layer disposed on the outer surface of said tube and covering said aperture means, and a second layer wrapped over said first layer.

11. The probe of claim 10, and including a foraminous protective layer disposed on the outer surface of said second layer.

12. The probe of claim 9, wherein said material has sufficient strength and integrity to be stretched circumferentially of said tube without tearing.

13. A microphone probe for acoustical measurement in turbulent flow, comprising a tube to be disposed in a sound field and having a closed end facing upstream of said sound field toward the source of sound energy, sound receiving means communicating with the downstream end of said tube, aperture means in said tube and located between said closed end and said sound receiving means, a first layer of acoustically resistive material disposed on the outer surface of said tube and covering said aperture means, a second layer of acoustic resistive material disposed over said first layer and extending substantially around the entire circumference of said tube, said second layer having a pair of longitudinal side edges disposed in adjacent relationship, and clamping means interconnecting said side edges for clamping said second layer around said tube and stretching said layers over said aperture means.

14. The probe of claim 13, and including a third layer of foraminous material disposed on the outer surface of said second layer, said third layer being substantially coextensive in circumferential dimension with said second layer and having a pair of longitudinal side edges disposed in adjacent relationship, said clamping means interconnecting the longitudinal side edges of said third layer.

15. The probe of claim 14, wherein said third layer is a metal screen.

16. The probe of claim 13, and including a longitudinally extending rigid member attached to each side edge, said clamping means including resilient means interconnecting said rigid members and exerting a force to urge said rigid members together to stretch said second layer around said tube.

17. The probe of claim 15, and including a resilient clamping member for clamping each side edge to the respective rigid member, said resilient means interconnecting said clamping members.

18. The probe of claim 16, wherein said clamping members are secured in closely spaced relation to the outer surface of said tube and are located substantially diametrically opposite said aperture means.

19. The probe of claim 1, wherein said end of said tube is closed by a plug of an acoustic medium.

20. An acoustical measuring apparatus, comprising a plurality of probe tubes disposed in spaced parallel relation to the sound field, each tube having a closed end facing a source of sound energy, aperture means in each tube and located downstream of the respective closed end, an acoustically resistive material disposed over each aperture means, clamping means for clamping said material to each tube and stretching said material across said aperture means, said clamping means comprising at least one rigid member disposed longitudinally of the respective tube and located in circumferentially spaced relation to the aperture means, said material being connected to said member, and connecting means for stretching said material across said aperture means, microphone means disposed in each tube downstream of said closed end for receiving sound energy propagating within said tube and converting said sound energy to an electrical signal, and means for summing the electrical signal produced by each of said microphone means,

21. The apparatus of claim 20, wherein the closed ends of said tubes are disposed within a longitudinal distance less than the wave length of the energy.

22. The apparatus of claim 20, and including a duct to contain said sound field, said probe tubes being disposed at circumferentially spaced positions within said duct.

23. An acoustical measuring apparatus, comprising a plurality of probe tubes disposed in generally parallel relation within a sound field, each probe tube having a closed end facing a source of sound energy, aperture means in each probe tube and located downstream of said closed end, an acoustically resistive material disposed over said aperture means, at least one rigid member disposed longitudinally of each tube and located in circumferentially spaced relation to the respective aperture means, said material being connected to said member, connecting means for stretching said material across said aperture means, opposite ends of said probe tubes disposed downstream of said aperture means being connected together at a junction, and sound receiving means located within said junction for receiving sound propagated through said probe tubes and converting said sound energy to an electrical signal.

24. The apparatus of claim 23, and including a duct to contain said sound field.

* * * * *